US007744143B2

(12) United States Patent
Gladfelter et al.

(10) Patent No.: US 7,744,143 B2
(45) Date of Patent: Jun. 29, 2010

(54) NONWOVEN PANEL AND METHOD OF CONSTRUCTION THEREOF

(75) Inventors: Harry F. Gladfelter, Kimberton, PA (US); Christopher A. Foy, West Chester, PA (US); David Briggs, Newburgh, IN (US); Eric K. Staudt, Reading, PA (US)

(73) Assignee: Federal Mogul Powertrain, Southfield, MI (US)

( * ) Notice: Subject to any disclaimer, the term of this patent is extended or adjusted under 35 U.S.C. 154(b) by 280 days.

(21) Appl. No.: 11/971,484

(22) Filed: Jan. 9, 2008

(65) Prior Publication Data

US 2008/0211253 A1 Sep. 4, 2008

Related U.S. Application Data

(60) Provisional application No. 60/884,368, filed on Jan. 10, 2007, provisional application No. 60/884,534, filed on Jan. 11, 2007.

(51) Int. Cl.
*B62A 25/00* (2006.01)
*B27N 3/02* (2006.01)

(52) U.S. Cl. ..... 296/39.3; 156/62.2

(58) Field of Classification Search ..... 296/39.1, 296/39.3, 191; 156/62.2
See application file for complete search history.

(56) References Cited

U.S. PATENT DOCUMENTS

| | | | |
|---|---|---|---|
| 4,029,839 | A | 6/1977 | Lesti |
| 5,718,802 | A | 2/1998 | Collier et al. |
| 5,814,170 | A | 9/1998 | Shibusawa et al. |
| 6,037,282 | A | 3/2000 | Milding et al. |
| 6,316,088 | B1 | 11/2001 | Ogawa et al. |
| 6,443,257 | B1 | 9/2002 | Wiker et al. |
| 6,568,142 | B2 | 5/2003 | Yoshida |
| 6,641,758 | B1 | 11/2003 | Arentsen et al. |
| 6,841,231 | B1 | 1/2005 | Liang et al. |
| 6,845,869 | B1 | 1/2005 | Graf von Deym et al. |
| 6,941,720 | B2 | 9/2005 | DeFord et al. |
| 2001/0046587 | A1 | 11/2001 | Michael et al. |

(Continued)

FOREIGN PATENT DOCUMENTS

| | | | |
|---|---|---|---|
| EP | 0824061 | A2 | 2/1998 |

(Continued)

OTHER PUBLICATIONS

Toh, C.T; Chee, S.K.; Lee, C.H.; Wee, S.H., Geotextiles & Geomembranes, 1994, vol. 13(6-7).

(Continued)

*Primary Examiner*—Lori L Lyjak
(74) *Attorney, Agent, or Firm*—Robert L. Stearns; Dickinson Wright, PLLC

(57) ABSTRACT

A nonwoven material and method of construction thereof from post consumer mixed Asian cardboard for forming structural and/or acoustic and/or thermal panels. The method includes providing post consumer mixed Asian cardboard and comminuting the cardboard into pieces of a predetermined size. Further, combining the reduced sized cardboard pieces with heat bondable textile fibers to form a substantially homogenous mixture, and then, forming a web of the mixture, with the web having a predetermined thickness, in a dry nonwoven webbing process. Then, heating the web to bond the heat bondable material with the reduced size pieces of mixed Asian cardboard to form the nonwoven material.

6 Claims, 5 Drawing Sheets

U.S. PATENT DOCUMENTS

| | | | |
|---|---|---|---|
| 2003/0056484 | A1 | 3/2003 | Oda |
| 2003/0075382 | A1 | 4/2003 | Fontaine |
| 2003/0089061 | A1 | 5/2003 | DeFord et al. |
| 2003/0134556 | A1 | 7/2003 | Christie et al. |
| 2005/0249931 | A1 | 11/2005 | Utsumi |
| 2005/0281999 | A1 | 12/2005 | Hofmann et al. |
| 2006/0035058 | A1 | 2/2006 | Ogawa et al. |
| 2006/0118667 | A1 | 6/2006 | Yamada |
| 2006/0128246 | A1 | 6/2006 | Anderegg |
| 2006/0289231 | A1 | 12/2006 | Priebe et al. |

FOREIGN PATENT DOCUMENTS

| | | | |
|---|---|---|---|
| JP | 6072466 | | 3/1994 |
| JP | 6136696 | | 5/1994 |
| JP | 6207362 | | 7/1994 |
| JP | 10235665 | | 9/1998 |
| JP | 11147211 | | 6/1999 |
| JP | 2000240266 | A | 9/2000 |
| JP | 2002127284 | | 5/2002 |
| JP | 2002240647 | A | 8/2002 |
| JP | 2004162246 | | 6/2004 |
| JP | 2004183181 | | 7/2004 |
| JP | 2004278160 | | 10/2004 |
| JP | 2005061045 | A | 3/2005 |
| JP | 2005113360 | | 4/2005 |
| JP | 2005253454 | | 9/2005 |
| JP | 2005350794 | | 12/2005 |
| JP | 2006043370 | | 2/2006 |
| JP | 4082712 | | 4/2008 |
| WO | WO03/070656 | | 8/2003 |

OTHER PUBLICATIONS

Jpn Nonwovens Rep, 2004, No. 11, pp. 42-47(P), Dan-Web.

Yamamoto, N., Nonwovens Rev., 2004, vol. 15, No. 3, pp. 6-9(P), Ikegami Kikai.

Skyt, A., Nonwovens World, 2004, vol. 13, No. 3, Jun.-Jul. 2004, p. 57(P), Dan-Web.

Yamamoto, N., Nonwovens Rev., 2004, vol. 14, No. 4, 2004, pp. 86-87 (P), Ikegami Kikai.

New Mater. Jpn, 2003, pp. 4-5(P), Katsuyama Technos.

Jpn Nonwovens Rep., 2003, No. 5, May 2003, pp. 65-66 (P).

Honshu Paper Mfg. Co. Ltd., Jap.pat. Kokai 43,359/81, Apr. 22, 1981 4 p. CI.D04H1/60. Filed: Jap. appln. 117,406/79 Sep. 14, 1979, 1981.

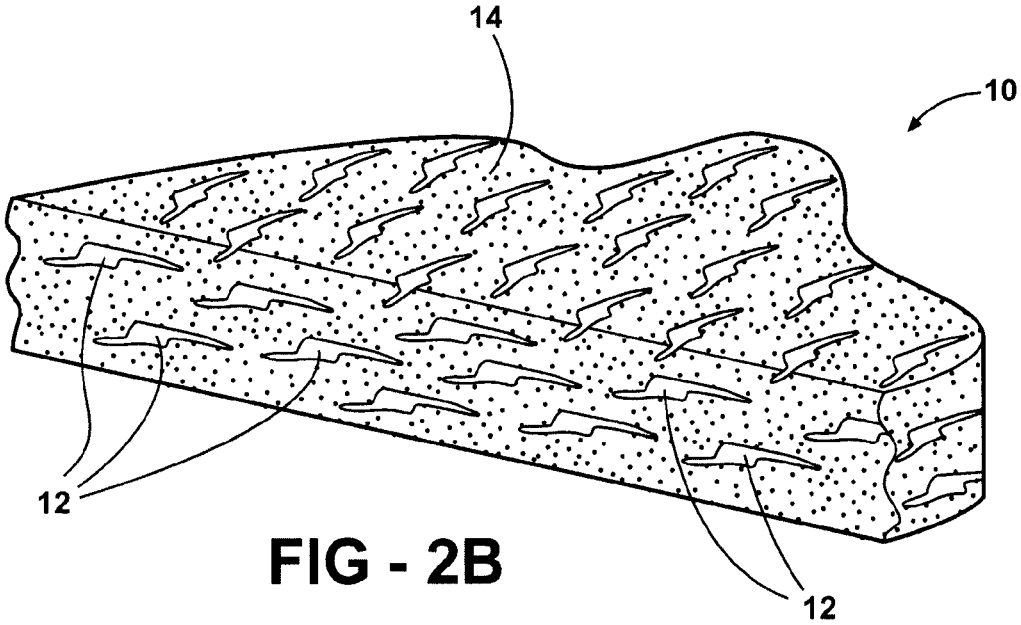
FIG - 2B
FIG - 3
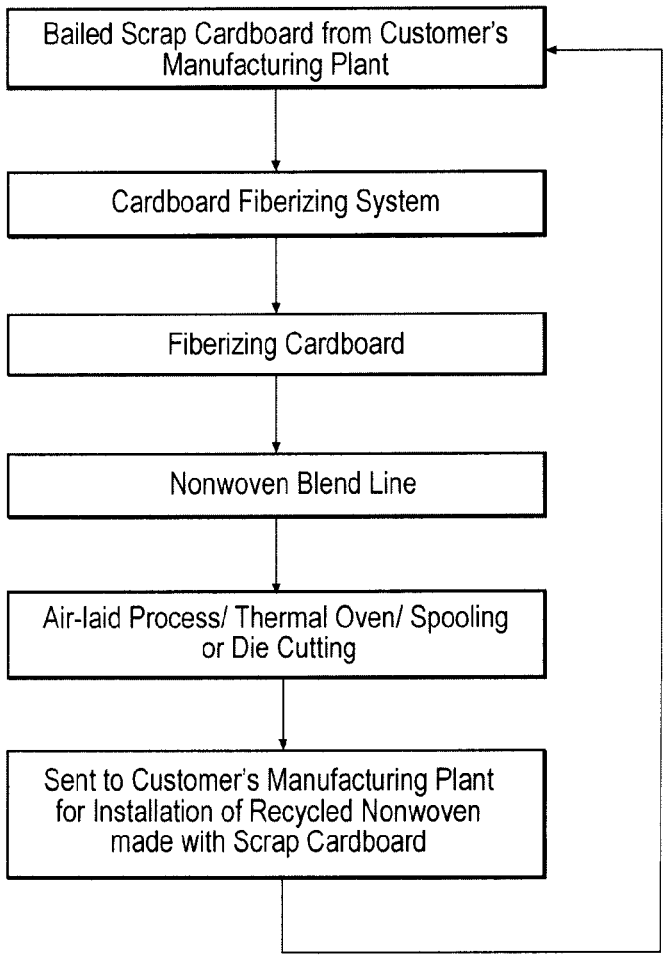

NONWOVEN PANEL AND METHOD OF CONSTRUCTION THEREOF

CROSS-REFERENCE TO RELATED APPLICATIONS

This application claims the benefit of U.S. Provisional Application Ser. No. 60/884,368, filed Jan. 10, 2007, and U.S. Provisional Application Ser. No. 60/884,534, filed Jan. 11, 2007, which are incorporated herein by reference in their entirety.

BACKGROUND OF THE INVENTION

1. Technical Field

This invention relates generally to nonwoven panels and methods for their construction, and more particularly to acoustic, thermal and/or structural panels constructed at least partially from waste material constituents ordinarily not suitable for reprocessing, more particularly, a mixture including Asian cardboard.

2. Related Art

In order to reduce the costs associated with manufacturing nonwoven fabrics and materials and to minimize potentially negative affects on the environment, many consumer products are constructed using recycled constituents. For example, automobile manufacturers in the United States use recycled materials to construct nonwoven fabrics and materials having various uses, including sound absorption and/or insulation materials. Some reclaimed or recycled materials used to construct sound absorbing vehicle panels include fabric shoddy, such as, for example, cotton, polyester, nylon, or blends of recycled fabric fibers. Cotton shoddy is made from virgin or recycled fabric scraps that are combined and needled to form a nonwoven fabric. Another product constructed from recycled standard cardboard papers or fibers, used on a limited basis to absorb oils, is Ecco paper. In the process of constructing Ecco paper, the standard cardboard fibers are broken down using conventional wet recycling techniques, wherein constituent binder ingredients of the recycled cardboard are flushed into a waste stream, and the remaining fibers are combined with various additives.

U.S. commercial establishments and consumer product manufacturers, for example, automotive component parts and original equipment manufacturers, receive numerous shipments from various Asian countries, such as China and Korea, in boxes or containers constructed of low grade "Asian cardboard." The Asian cardboard has constituents of very short, very fine fibers from previously recycled pine cardboard, as well as bamboo and rice fibers. As such, attempts to recycle Asian cardboard into paper, cardboard or other structural panel products through the paper mill process has been met with failure, with the very fine constituents of the Asian cardboard being flushed through the screens or mesh used to carry pulp in the paper/cardboard manufacturing process into the environment via the resulting waste stream of the recycling process. Accordingly, Asian cardboard is typically considered to be waste, and thus, is either sorted from standard cardboard at a relatively high labor cost and sent to landfills (during sorting, the Asian cardboard is readily identifiable from standard cardboard due to its relatively flimsy structure and its pale brown or greenish color) or the entire bale is scraped if there is more than 5% Asian cardboard mixed in a bale of recycled cardboard, also with a relatively high cost to both the product manufacturer and the environment.

SUMMARY OF THE INVENTION

According to one aspect of the invention, a method of constructing a nonwoven sheet material from post consumer mixed Asian cardboard (with at least 5% to 100% Asian cardboard) is provided, wherein the sheet material constructed is useful for forming structural and/or acoustic and/or thermal panels. The method includes providing post consumer mixed Asian cardboard and comminuting the cardboard into pieces of a predetermined size. Further, combining the reduced sized pieces of cardboard with heat bondable textile fibers to form a substantially homogenous mixture, and then, forming a web of the mixture, with the web having a predetermined thickness, in a dry nonwoven webbing process. Then, heating the web to bond the heat bondable material with the reduced size pieces of mixed Asian cardboard to form the nonwoven sheet.

According to another aspect of the invention, a method of providing predetermined quantitative acoustic absorption properties in a nonwoven acoustic panel is provided. The method includes comminuting cardboard material into cardboard fragments or "nits"; providing fragments of polymeric material (e.g. recycled polypropylene rags), and forming a web by mixing the cardboard fragments with the fragments of polymeric material in a dry nonwoven webbing process. Further, the method includes controlling the size of the cardboard fragments being mixed in the web and the percent by weight of the cardboard fragments being mixed in the web. Then, heating the web and causing the polymeric fragment to bond with the cardboard fragments.

According to yet another aspect of the invention, a structural nonwoven product is provided. The structural nonwoven product includes more heat bondable textile material and comminuted cardboard material. The cardboard material is bonded with the heat bondable textile material to form the nonwoven structural product.

According to yet a further aspect of the invention, a method of manufacturing a vehicle component is provided. The method includes receiving a shipment of goods in cardboard containers and reclaiming at least some of the cardboard containers. Next, reducing the reclaimed cardboard containers by grinding or shredding the reclaimed cardboard containers into a dry fibrous state and combining the reduced reclaimed cardboard with a binder material. And then, shaping the combined reduced reclaimed cardboard and binder material to form the vehicle component.

Accordingly, the invention herein overcomes the limitations discussed above by providing nonwoven panels, such as those suitable for use in acoustic, thermal or structural applications and methods for their construction by recycling selected types of cardboard materials and using them in combination with heat bondable textile materials to create a nonwoven acoustical, thermal or otherwise structural panels that can be used in a variety of applications, such as in automobiles.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

FIGS. 2A and 2B are enlarged cross-sectional views of the nonwoven panel of FIG. 1 showing different weight percents of the panel constituents;

FIG. 3 is a process flow diagram illustrating a method of constructing a nonwoven material in accordance with one aspect of the invention.

DETAILED DESCRIPTION OF PRESENTLY PREFERRED EMBODIMENTS

Figure 1:
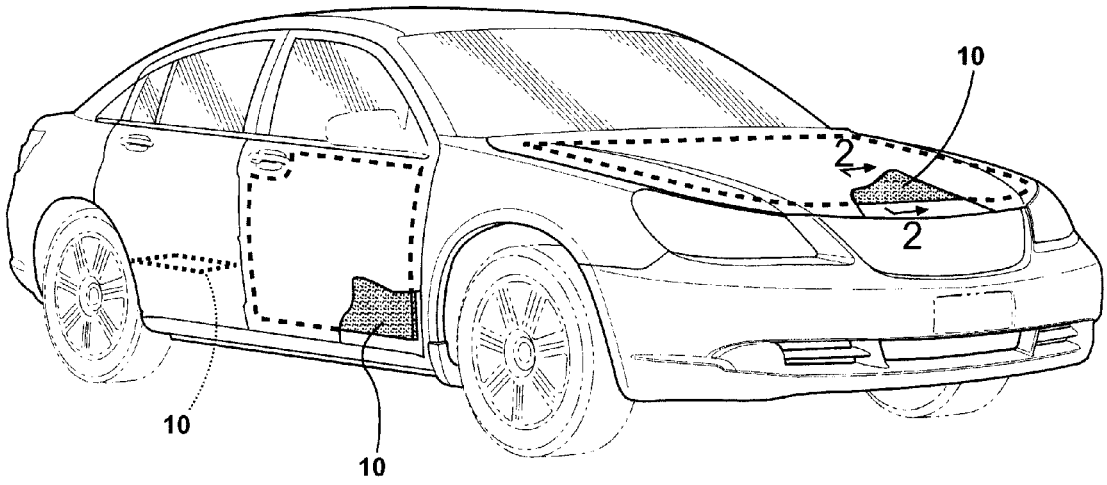
FIG. 1 is a perspective view of a nonwoven panel constructed in accordance with one presently preferred aspect of the invention.
Figure 2A:
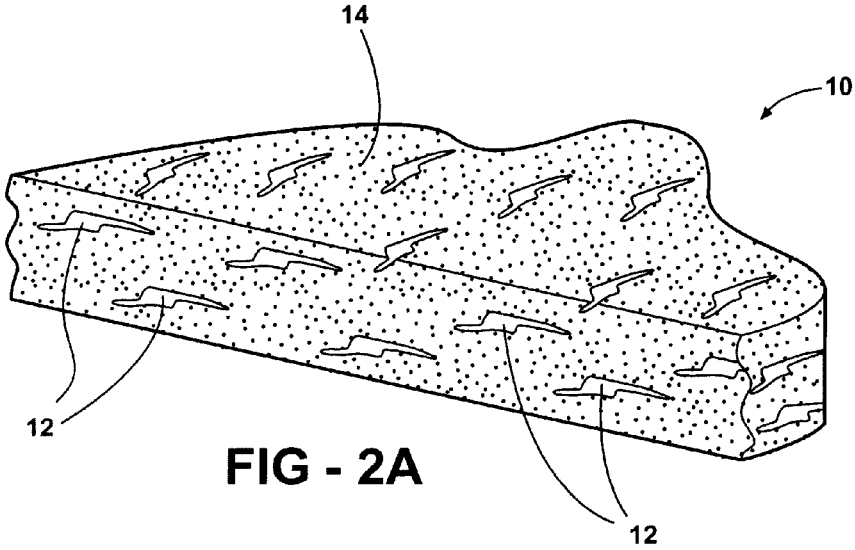

Referring in more detail to the drawings, FIG. 1 illustrates a structural member or panel 10 constructed in accordance with one aspect of the invention. The panel can be configured for use in any number of applications, such as for an automotive vehicle component, for example. The panel 10, aside from being capable of providing a formable structural member, can be fabricated with noise damping or attenuation properties, thus, functioning as an acoustic panel. Further the panel 10 can be constructed having fire retardant properties, if intended for use in high temperature environments, such as near an exhaust system or within a vehicle engine compartment, for example. The panel 10 is constructed from mixed Asian cardboard, filler fibers, and bi-component fibers, with the processed cardboard materials being bonded in the form of the panel 10 by low temperature, heat bondable textile fiber and/or other suitable binder materials. With the panel 10 being constructed at least in part from post consumer or recycled cardboard materials 12, the environment is benefited, such that the reclaimed cardboard is kept from being sent to landfills or from being incinerated.

The mixed recycled cardboard material 12 can be provided as any mixture of Asian (an inferior grade of cardboard commonly produced in Asian countries, e.g. China and Korea and shipped into the U.S., which is typically considered non-recycleable by various state environment agencies heretofore, such as in Connecticut, New Hampshire and Massachusetts) and standard cardboard material (that made from wood, such as pine, which is typical in the U.S). Because recyclers typically allow only 5% Asian cardboard mixed with the "Standard Cardboard", the focus of this patent is on recycled cardboard with between 5% and 100% Asian cardboard. This "Standard" and "Asian" mixture will hereafter be referred to as "mixed Asian cardboard". As such, a method of recycling cardboard materials for use in manufacturing vehicle components, in accordance with one aspect of the invention, negates the need to separate inferior, low-grade cardboard materials, including Asian cardboard, from higher grade cardboard, such as that manufactured in the U.S. Accordingly, piles, bundles, or mixtures of standard high grade cardboard material from cardboard containers can be readily recycled in combination with the Asian cardboard without concern of separating the two types of cardboard materials from one another. The content of the cardboard, whether mixed or 100% Asian, is preferably between about 25-99 weight percent of the total web weight, depending on the desired characteristics of the panel 10 being constructed. Generally, about 25% recycled material in a new product is needed in order to be considered a "Recycled" product.

The Asian cardboard is considered to be a low grade, non-recycleable cardboard due to its being constructed from inferior constituent ingredients, such as low quality recycled fibers, bamboo fibers, jute, rice fibers, and/or other scrap/waste materials. As such, Asian cardboard is typically considered to be a serious non-recycleable contaminant, whether on its own or if bailed or otherwise included in reclaimed post consumer cardboard loads. Accordingly, if Asian cardboard is bailed with standard U.S. cardboard, then the entire bail or load is typically considered to be non-recycleable waste (again, typically including a content of Asian cardboard above 5%). Asian cardboard can be distinguished from higher quality U.S. cardboard by its flimsiness and characteristic pale brown, yellow or greenish color. Accordingly, Asian cardboard is typically separated from higher U.S. quality cardboard, and sent to landfills, burned, or otherwise disposed.

The inability of Asian cardboard to be recycled stems from the constituent ingredients of the inferior fibers used in the construction of the Asian cardboard, which are generally very short and thus very weak. Given the relatively fine size of the fibers and other powdery ingredients in Asian cardboard, if the Asian cardboard is processed in known wet recycling processes along with standard cardboard having fibers of an increased length, the ingredients of the Asian cardboard get flushed through the screens and carried into the waste stream and/or plug and otherwise damage the recycling equipment. Accordingly, in accordance with the invention, the construction of the panel 10 is performed in a dry process, thereby allowing the utilization of the inferior Asian cardboard along with the fibers having a length less than 0.2 mm (referred to as "fines") in it's manufacture.

The heat bondable textile material can be provided, for example, as a low temperature melt polymeric material, such as fibers of polyethylene, PET or Nylon. It should be recognized that other low melt polymeric materials could be used, such as thermoplastic bi-component fibers whose outer sheath, such as polypropylene, for example, melts when heated above its melting point. This melted resin then fuses with the mixture of any textile fibers present and the cardboard fibers and with remaining binders from the recycled cardboard materials. As an example, the melting point of the outer portion of a PET low melt fiber may be approximately 110° C.-180° C. as compared to the core melting at 250° C. Persons skilled in the art will recognize that other coatings or fillers and filler fibers may be used in place of low melt fibers to achieve the desired result, and further that the heat bondable material 14 can be used in combination with or replaced by a binder (for example, less low melt fiber can be used if a binder is used to stiffen the feel of the fabric). An SBR with a Tg of +41 is an example of a binder that can be used. Further, the heat bondable textile materials can be combined with other organic or inorganic fibers and/or coated with heat resistant or fire retardant (FR) coatings (Ammonium Sulfate, Ammonium Phosphate, or Boric Acid, for example) and/or coated with an anti-microbial coating (Polyphase 678, Rocima 200, or UF-15, for example) on at least one of the heat bondable textile materials or the recycled cardboard material. This is similar to the cellulose insulation industry where an FR treatment and a mildeweide are added to the paper during the fiberization process.

Figure 4:
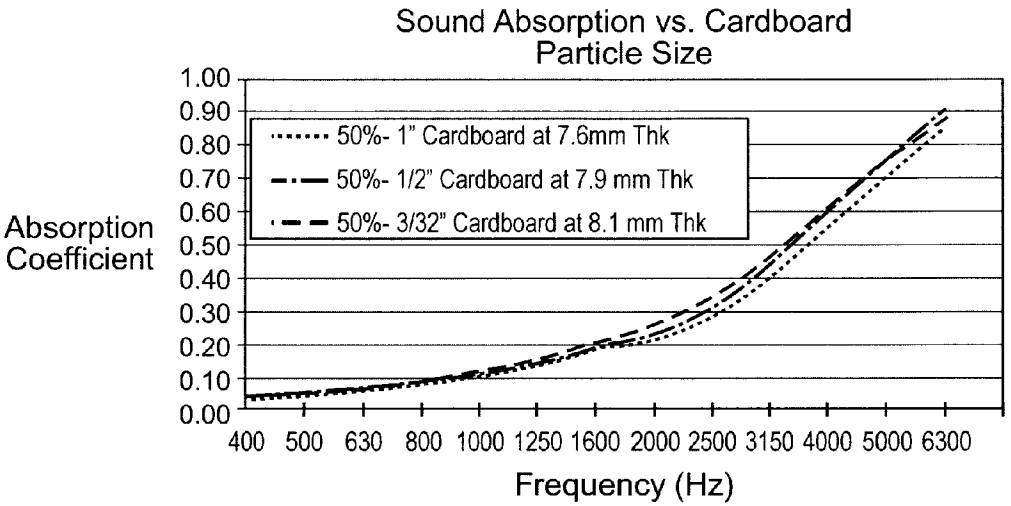
FIG. 4-8 are graphs illustrating sound absorption characteristics of a nonwoven material constructed in accordance with the invention.
Figure 5:
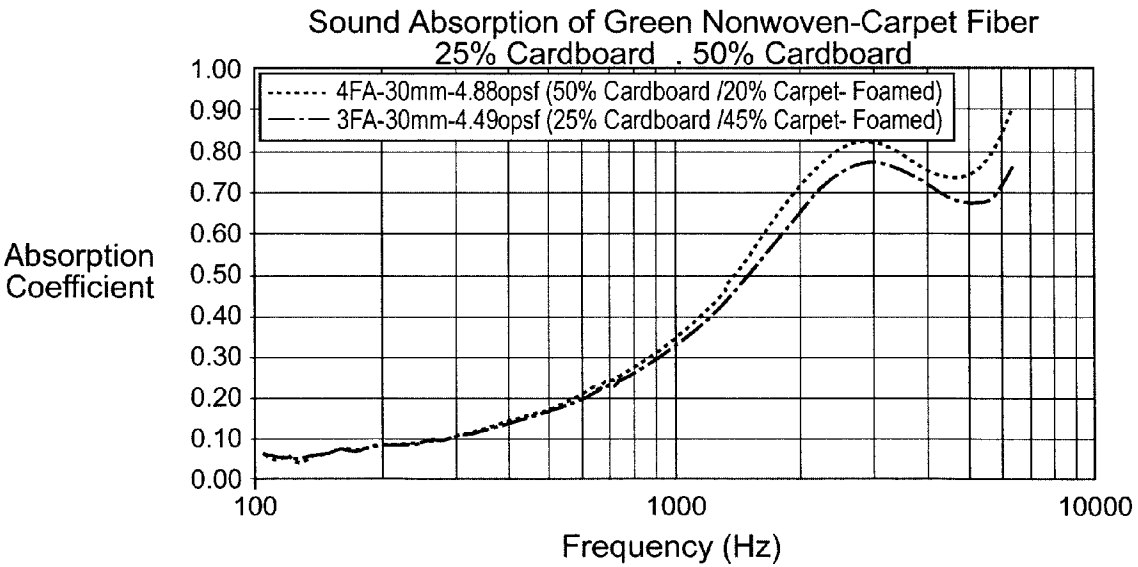
Figure 6:
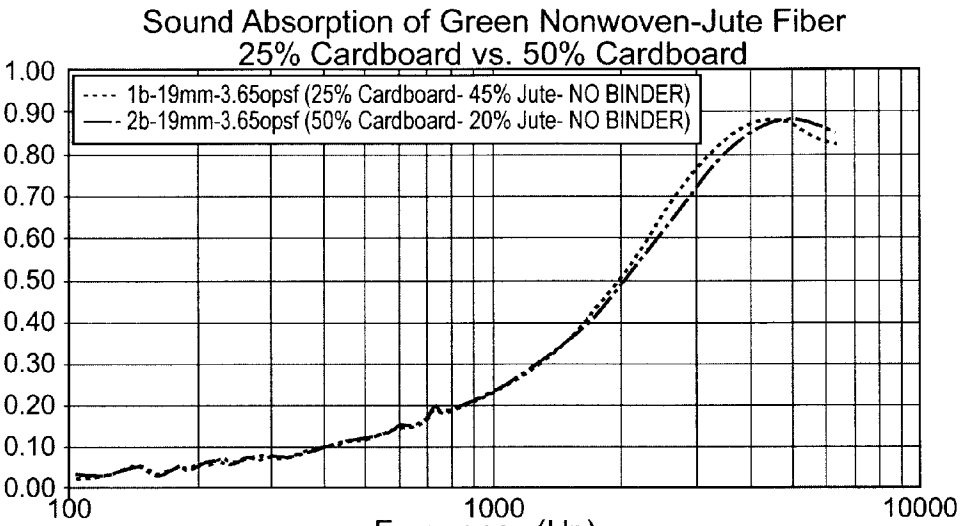
Figure 7:
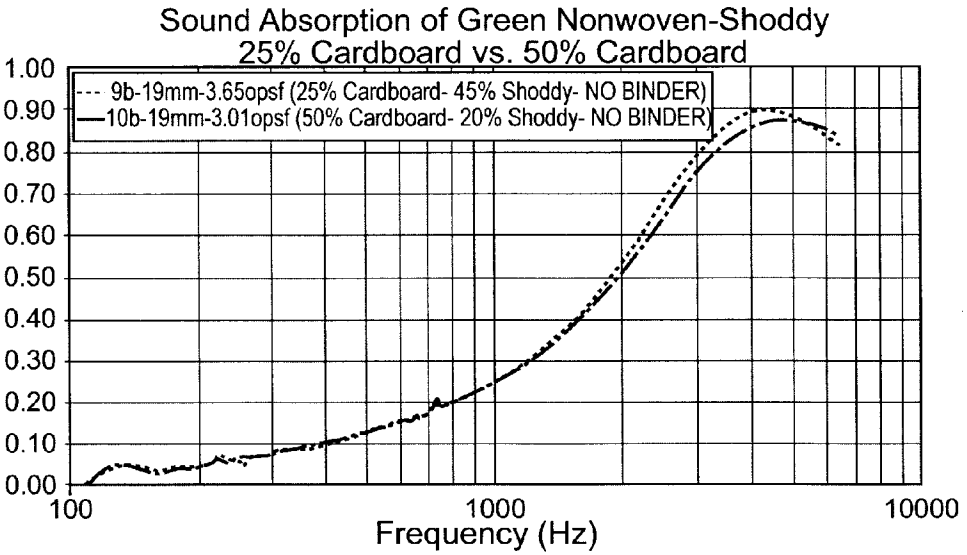
Figure 8:
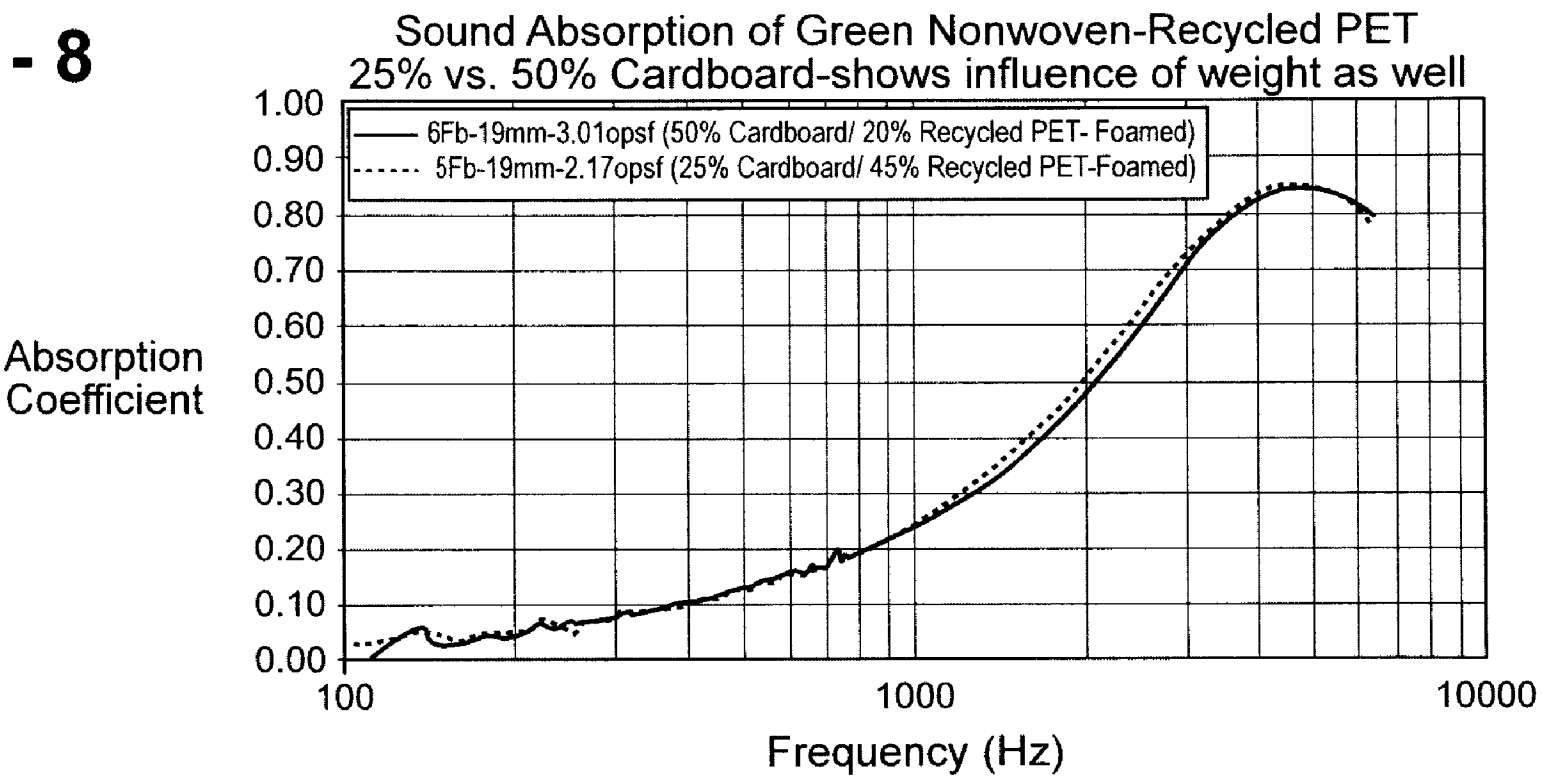

In accordance with another aspect of the invention, a method of manufacturing the acoustic, and/or thermal panels 10 is provided. The method includes providing the reclaimed or recycled cardboard materials 12, as discussed above, such as by reclaiming the cardboard materials from containers carrying goods shipped to a manufacturer, such as an automotive components manufacturer, for example. Then, comminuting the cardboard materials 12 into the desired size pieces and/or dry fibrous state, such as in a chopping, shredding, and/or grinding operation. It is contemplated that when the mixed Asian cardboard is being used, that the pieces be fiberized using a screen size between 3/32" and 1/2" when using the hammer-mill type method. This produces a similar sized fiber and nit of that in the blown insulation industry. Depending on the characteristics sought, such as acoustic damping or structural characteristics, the size of the comminuted pieces or nits can be altered. It has been found that by altering the size of the pieces, the acoustic absorption properties of the panels 10 changes. Using a hammer-mill to fiberize the cardboard, the cardboard particle size is determined by the size of the screen used. This screen size is not the actual size of the cardboard particles or nits that are formed. The actual size of the largest pieces is closer to half the screen size. However, much of the cardboard within a certain labeled size is also smaller than half the size of the screen size and includes particle sizes down to dust size (also called "fines"). Approximately one half the mass of the cardboard in each labeled size are "large" pieces (meaning half the screen size) and the other half is smaller pieces with lot of dust. As shown in FIG. 4, test samples containing 50% cardboard, 30% low-melt PET, 20% Shoddy with no coating or binder, show the correlations between cardboard particle size versus sound absorption values. Basically, the smaller the sized "nit" the higher the sound absorption for the insulation. The textile manufacturing process must also be taken into account as to what sized particles will run most efficiently and practically. This may change the final air-laid system depending on what sized fiber nit is determined to best suit the application, keeping in mind that using the most "dust" that is produced in the fiberizing system is the best environmental option which may also negatively affect the "dust-out" requirements. If using a hammer mill, the screen may be oriented in various directions or take on various shapes, including circular, vertical, or horizontal. If the ground/hammer-milled mixture will be combined with textile fibers, it is then fluffed to facilitate being mixed with the textile fibers.

Another aspect of the invention includes changing the percentage of cardboard used in the panel to customize the sound absorption curve of the final panel. Depending on what "filler" fiber is used, the cardboard may increase the sound absorption values or it may actually decrease the sound absorption values of the final panel. As shown in FIGS. 5 through 8, examples of how the absorption curves differ with different filler fibers when the amount of fiberized mixed cardboard is increased. Jute, recycled carpet, recycled shoddy, and recycled white PET fibers were all used for the filler fibers. In these particular tests, the amount of cardboard used was 25% and 50% of the total panel weight. These tests showed that the more fiberized mixed Asian cardboard percentage the higher the sound absorption within the frequency range tested for the Jute, recycled carpet, and recycled shoddy. The recycled white PET fibers showed lower sound absorption with the addition of more mixed Asian cardboard. This leads to the belief that the more mixed Asian cardboard in the lower performing fibers, the better the absorption values and the more mixed Asian cardboard in the higher performing fibers, the worse the absorption values of the nonwoven. However, this is not a hard and fast rule because the size of the nits/dust will also affect the absorption values. These tests used a 3/8" screened hammer-milled product. Because of some preliminary testing, there is reason to believe, a high percentage of very small nit mixed Asian cardboard along with the fines, can produce a panel with superior sound absorption as compared to PET fibers. By changing the percentage of mixed Asian cardboard used in the panel along with the size of the nits, the panel can be engineered to have any absorption curve required by the application while reducing the waste stream.

The hammer-milled fibers and fragments of the cardboard 12 are next blended with any desired recycled or virgin textile fibers, which may include the low-melt fibers 14 or other binder materials, as mentioned. The proportion of the hammer-milled fibers and fragments of cardboard 12 to textile fibers 14 can be varied between about 25 to 99 weight percent (wt %) of the finished panel 10. The proportion of low-melt fibers 14 to recycled cardboard fibers 12 can be varied as best suited for the intended application of the panel 10, but the low melt fibers 14, if any, and are generally provided to be between about 5% to 45 wt % of the panel 10.

The mixture is then subjected to a nonwoven webbing process, which may be performed, for example, on a Rando machine. The webbing process forms a homogenously mixed fiber/paper mat or web, with the fibers of the cardboard 12 being randomly oriented. The web is then run through a heat bonding oven to melt the low melt fibers, or if desired for the intended application, the web can be fed through a needle loom to be needle punched. The heating process may be performed by passing the web into or through any suitable oven, or by feeding it through one or more heated rollers. The resulting web may be passed between cooling rollers after heating to control its thickness and density. If needle punching the web, a thin nonwoven that resists tearing, or a scrim layer, may be applied to one or both sides of the web to prevent any of the cardboard fibers or pieces from building up on the needles, as build-up of cardboard on the needles is undesirable and may cause them to break. The scrim layer also serves as a "net" to control dust from being released from the web. Reemay fabric is one example of a scrim that can be used for this purpose. The scrim or protective layer of fabric may additionally add strength to the web and facilitate the webbing process. The web can also be coated with a binder that further binds all of the fibers and paper in place and prevents it from forming dust (SBR, Acrylic, or Latex binders are some examples of what can be used). Flame retardant additives can also be added to the coating. Upon applying the binder, it is preferably dried and cured.

The web can then be rolled up or cut into desired lengths. A cutting press, or a comparable apparatus, can be used to separate the roll/sheets into panels or parts as dictated by the application of the fiber product.

The resulting nonwoven fiber panels 10 may have a thin nonwoven fabric or scrim layer attached or bonded to one side or both sides, or the scrim layer may be sandwiched between layers of the nonwoven fiber panels 10. The scrim layer can be bonded using a suitable heat resistant adhesive, a low-melt blend of fibers within the scrim, or it can be attached via stitch-bonding.

The nonwoven panels 10 constructed in accordance with the invention are suitable for use in a variety of applications, including acoustic panels and thermal panels in automobiles. Such applications more specifically include the acoustic panels between the finished interior panel and the steel of the car, including, the headliner, side door panels, the trunk, and under the carpet. Thermal applications include, for example, heat shields with the addition of a reflective layer, such as adjacent exhaust system components or within an engine compartment.

Many modifications and variations of the present invention are possible in light of the above teachings. It is, therefore, to be understood that the invention may be practiced otherwise than as specifically described.

What is claimed is:

1. A nonwoven vehicle panel, comprising:

a heat bondable textile material; and a recycled post consumer Asian cardboard material, said recycled cardboard material being bonded with said heat bondable textile material.

2. The vehicle panel of claim 1 wherein said Asian cardboard material comprises at least 5 weight percent of said vehicle panel.

3. The vehicle panel of claim 2 wherein said Asian cardboard material comprises at least 25 weight percent of said vehicle panel.

4. The vehicle panel of claim 1 further comprising a flame retardant coating on at least one of said heat bondable textile material or said recycled post consumer Asian cardboard material.

5. The vehicle panel of claim 1 further comprising an anti-microbial coating on at least one of said heat bondable textile material or said recycled post consumer Asian cardboard material.

6. The vehicle panel of claim 1 wherein said heat bondable textile material is PET.

* * * * *